US005240243A

United States Patent [19]

Gompertz et al.

[11] Patent Number: 5,240,243

[45] Date of Patent: * Aug. 31, 1993

[54] HANGING BIN FOR UNIFORMLY STACKING CUT SHEETS AT THE OUTPUT OF A PLOTTER

[75] Inventors: Ronald S. Gompertz; Victor Escobedo, both of San Diego, Calif.

[73] Assignee: Hewlett-Packard Company, Palo Alto, Calif.

[ * ] Notice: The portion of the term of this patent subsequent to May 5, 2009 has been disclaimed.

[21] Appl. No.: 862,918

[22] Filed: Apr. 6, 1992

Related U.S. Application Data

[63] Continuation-in-part of Ser. No. 486,332, Feb. 28, 1990, Pat. No. 5,110,111.

[51] Int. Cl.[5] ..... B65H 31/00

[52] U.S. Cl. ..... 271/209; 271/186; 271/223

[58] Field of Search ..... 271/186, 207, 209, 213, 271/223, 224; 220/485, 486

[56] References Cited

U.S. PATENT DOCUMENTS

| | | | |
|---|---|---|---|
| 3,269,556 | 8/1966 | Streater | 220/486 X |
| 3,460,850 | 8/1969 | Franklin | 220/486 X |
| 3,704,793 | 12/1972 | Nicol et al. | 271/207 X |
| 4,220,323 | 9/1980 | Smith | 271/186 X |
| 4,804,174 | 2/1989 | ter Horst | 271/209 X |
| 4,828,248 | 9/1989 | Jackson . | |
| 5,110,111 | 5/1992 | Gompertz et al. | 271/213 X |

FOREIGN PATENT DOCUMENTS

| | | | |
|---|---|---|---|
| 0248485 | 9/1987 | European Pat. Off. . | |
| 2943851 | 5/1980 | Fed. Rep. of Germany . | |
| 135049 | 10/1980 | Japan | 271/223 |
| 58-130855 | 10/1983 | Japan . | |
| 198252 | 11/1984 | Japan | 271/209 |
| 166157 | 7/1991 | Japan | 271/207 |
| 1370041 | 1/1988 | U.S.S.R. | 271/207 |

*Primary Examiner*—Robert P. Olszewski
*Assistant Examiner*—Born Milef

[57] ABSTRACT

A suspendable or hanging sheet receiving bin for a printer or plotter which includes a front wall, a back wall, and a bottom wall, all joined together in a bar or wire grid network to define a sheet receiving region. The sheet receiving region has a length dimension, a width dimension, and a depth dimension all defining at one end of the bin an opening for receiving paper fed from the output of the printer or plotter. The front wall of the bin includes a plurality of U-shaped or hook-shaped members having upwardly faced convex surfaces for receiving stacked sheets of paper falling into the opening of the bin and for enabling the sheets to be stacked uniformly and readily accessible to an operator for removal from the bin after the completion of the printing or plotting operation. Advantageously, the bin is provided with an adjustable tray or lever member which may be positioned at different locations along the depth dimension of the bin for receiving different length sheets from the plotter or printer. Additionally, hook members or the like are provided on the wire or bar grid network for positioning the depth dimension of the bin at a predetermined angle with respect to the free fall vertical direction of paper ejected from the printer or plotter.

7 Claims, 9 Drawing Sheets

HANGING BIN FOR UNIFORMLY STACKING CUT SHEETS AT THE OUTPUT OF A PLOTTER

RELATED APPLICATION

This application is a continuation-in-part of our now allowed application Ser. No. 07/486,332 entitled "Method and Apparatus For Uniformly Stacking Cut Sheets of Printed Media", filed Feb. 28, 1990 now U.S. Pat. No. 5,110,111.

TECHNICAL FIELD

This invention relates generally to the accumulation of cut sheets of printed media received from a printer or plotter. More particularly, this invention is directed to an improved method and apparatus for transporting and stacking the cut sheets of printed media in such a manner as to minimize crumpling and curling of the stacked sheets.

BACKGROUND ART

Printers and plotters used for generating text and graphics on cut sheets of printed media have previously been equipped with literally hundreds of different types of media accumulating apparatus. These apparatus are either an integral part of the printer or plotter or they are removably attached thereto and are normally readily accessible to an operator for retrieving the media having text or graphics printed thereon. In the field of plotters and particularly large format plotters which produce correspondingly large size sheets of printed media, a problem of sheet crumpling and curling is presented by the manner in which these sheets are transported and stacked after printing or plotting thereon.

In the past, many differently configured devices have been used for the collection of these cut sheets and have been variously referred to in these arts as "catch trays", "catch bins", "paper collection trays" and the like. However, none of these known passive prior art media collection devices have been operative to prevent a certain undesirable crumpling and curling of the cut sheets and stack and arrange the cut sheets in an orderly fashion. This fact has in part been a result of the specific configurations of these sheet collection devices and their corresponding media handling and operational characteristics. More particularly, this introduction of crumple and curl into the accumulated cut sheets has been a result of the environmental conditions (e.g. humidity) and winding tension to which the paper is subjected at the manufacturer, coupled with the inability of these paper and media handling devices to uniformly distribute the weight of the accumulated media during both media transport and stacking. This introduction of crumple and curl into the cut sheets has also been a result of the inability of these prior art paper stacking apparatus to adequately move cut sheets out of the way of the upstream moving paper, sometimes causing the paper to jam up in the plotter and be crushed. Additionally, when conventional paper trays are used to accumulate cut sheets being fed into the tray one after another and sliding on top of the previous sheet, the sheets may hit earlier received sheets unevenly at the edges when the latter become skewed in the tray. This can also aggravate the problem of sheet curling and buckling.

Other active types of paper collection devices such as reciprocating tables have been known to work quite well in certain applications and environments. However, these "active" devices require motors, control logic and related electronic circuitry and involve significantly higher costs relative to passive paper stacking devices of the type disclosed and claimed herein.

DISCLOSURE OF INVENTION

Accordingly, it is an object of the present invention to provide an improved passive method and apparatus for the handling, transport and accumulation of printed media which minimizes the above crumpling and curling problem during media stacking. This invention thus represents a significant improvement in this regard relative to the paper handling and stacking properties and capabilities of any presently known passive prior art devices such as "catch trays", "catch bins", or the like.

In a preferred embodiment of this continuation-in-part application, the above object is achieved by the construction of a unique and novel output paper collection bin which is operative to be suspended from a stand which carries a plotter. This suspension is such that the depth dimension of the bin is at a predetermined angle with respect to the free fall vertical direction of paper ejected from the printer or plotter. The paper receiving bin includes a front wall, a back wall, and a bottom wall all joined together in a bar or wire grid network. This network defines a sheet receiving region with a length dimension, a width dimension, and depth dimension defining at one end of the bin an opening for receiving paper fed from the output of the printer or plotter. The front wall includes a plurality of U-shaped or hook-shaped members having upwardly facing convex surfaces for receiving stacked sheets of paper falling into the opening of the bin. Thus, the sheets become stacked uniformly over the upwardly facing convex surfaces of the U-shaped or hook-shaped members and are there easily accessible for either removing the stack of sheets from the bin or alternatively for easily removing the entire hanging bin from the stand carrying the plotter or printer.

The present invention is also directed to a unique and novel method for transporting and then stacking sheets of printed media exiting an output sheet feeder of a printing mechanism. Each sheet is defined by at least a leading edge and a trailing edge, and each of the sheets is initially passed vertically downward a predetermined distance with respect to the output of the sheet feeder. Then the trailing edge of each sheet exiting the sheet feeder is rotated about an axis of rotation defined by the leading edge of the sheet and in a direction away from the sheet feeding mechanism. Next, a first section of each sheet is brought to a rest position at one location, and movement of a second section of each sheet is continued in a direction away from the sheet feeding mechanism and then into or toward a predefined plane of cut sheet accumulation.

In the above process, the second section of each of the stacked sheets forms a loop passing and extending from the first section of each sheet and into or toward the predefined plane of paper accumulation. This paper handling process improves the uniformity of the weight distribution within the stacked sheets and thereby minimizes the crumpling, curling, and slipping of the accumulated sheets of printed media. In addition, the radius of the above loop in the cut sheets serves to bend and guide the sheets in a manner which tends to avoid creasing the sheets during the sheet accumulating process.

Accordingly, a primary object of this continuation-in-part invention and application is to provide a new and improved hanging or suspension type paper collection bin for receiving cut sheets fed from the output of a printer or plotter and which may be easily attached and removed from a stand constructed for carrying the printer or plotter.

Another object of this invention is to provide a new and improved paper stacking apparatus of the typed described which is completely "passive" and which requires no moving parts such as motors.

Another object is to provide a new and improved paper stacking apparatus of the type described which operates to rapidly and efficiently move the cut sheets being stacked out of the way of upstream paper movement, thereby eliminating problems associated with jamming up the plotter from which the sheets are fed.

Another object of this invention is to eliminate sliding friction contact between successively stacked sheets being accumulated at the output of a plotter or printer.

Another object of this invention is to provide a new and improved media stacking apparatus for carrying out the above method and one which is of economical and durable construction.

Another object is to provide a new and improved media stacking apparatus of the type described which may be readily and easily adjusted for the handling of different types and sizes of printed media and which may also be used with many types of existing large scale plotters.

A novel feature of this invention is the provision of a new and improved hanging or suspension type paper collection bin which is adapted to be suspended on a stand carrying a plotter or printer. This hanging or suspended bin has a front wall which includes a plurality of U-shaped or hook-shaped members having upwardly facing convex surfaces for uniformly receiving stacked sheets of paper falling into an opening of the bin. The bin is suspended from the stand such that the depth dimension of the bin extends at a predetermined angle with respect to the free fall vertical direction of paper being ejected from the printer or plotter.

Another feature of this invention is the provision of media stacking apparatus of the type described which includes a sheet receiving bin having a back support member, a floor or bottom support member which is generally perpendicular to the back support member, and a front support member. The front support member is spaced from the back support member, and this space defines a gap portion for receiving the leading edge of cut sheets fed from a sheet feeder mechanism. The front support member includes a first section thereof which intersects the bottom support member at a preselected angle slants away from the back support member. The front support member further includes a second section which is integral with the first section and extends upwardly from the first section and also slants away from the back support member. The second section has an upwardly facing convex curvature for receiving sheets which are moving away from the sheet feeding mechanism, and the sheets fed toward the bottom support member of the sheet receiving bin will subsequently be received by the first and second sections of the front support member.

Sheet motion out of the sheet feeding mechanism is continuous so that each sheet is caused to extend over the second section of the front support member and then toward or into an adjacent plane of single sheet media accumulation. In a preferred embodiment of this invention, the second section of the front support member comprises a plurality of hook-shaped rib members which bend in a curvature away from the sheet feed mechanism.

Another feature of this invention is the provision of media stacking apparatus of the type described wherein the front support member, the back support member, and the bottom support member are all constructed of a grid framework of horizontal and vertical intersecting bars or wires. These bars or wires are arranged in such a way as to facilitate media motion and inhibit curl at the edges of the cut sheets.

Another feature of this invention is the provision of media stacking apparatus of the type described wherein the front support member intersects with the floor or bottom support member at a preselected angle with respect to a horizontal surface of the floor support member. This angle may be varied to change the degree of slant of the front support member depending upon the size and weight of cut sheets being accumulated.

Another feature of this invention is the provision of media stacking apparatus of the type described which further includes a tray member which extends horizontally above the bottom support member and between the front and back support members for receiving cut sheets passing vertically downward from the sheet feeding mechanism. When each cut sheet reaches the tray member which is spaced a given distance above the bottom member, it rotates about its leading edge axis of rotation and ultimately loops over the plurality of hook-shaped rib members. Each cut sheet then comes to rest into an output tray which advantageously may be a bar grid extension of the floor or bottom support member.

Another feature of this invention is the provision of a media stacking apparatus of the type described which is lightweight and collapsible thus assuring easy shipping, handling, and storage.

These and other objects, advantages, and features of this invention will become more readily apparent in the following description of the accompanying drawings.

DESCRIPTION OF THE PREFERRED EMBODIMENT

Figure 1A:
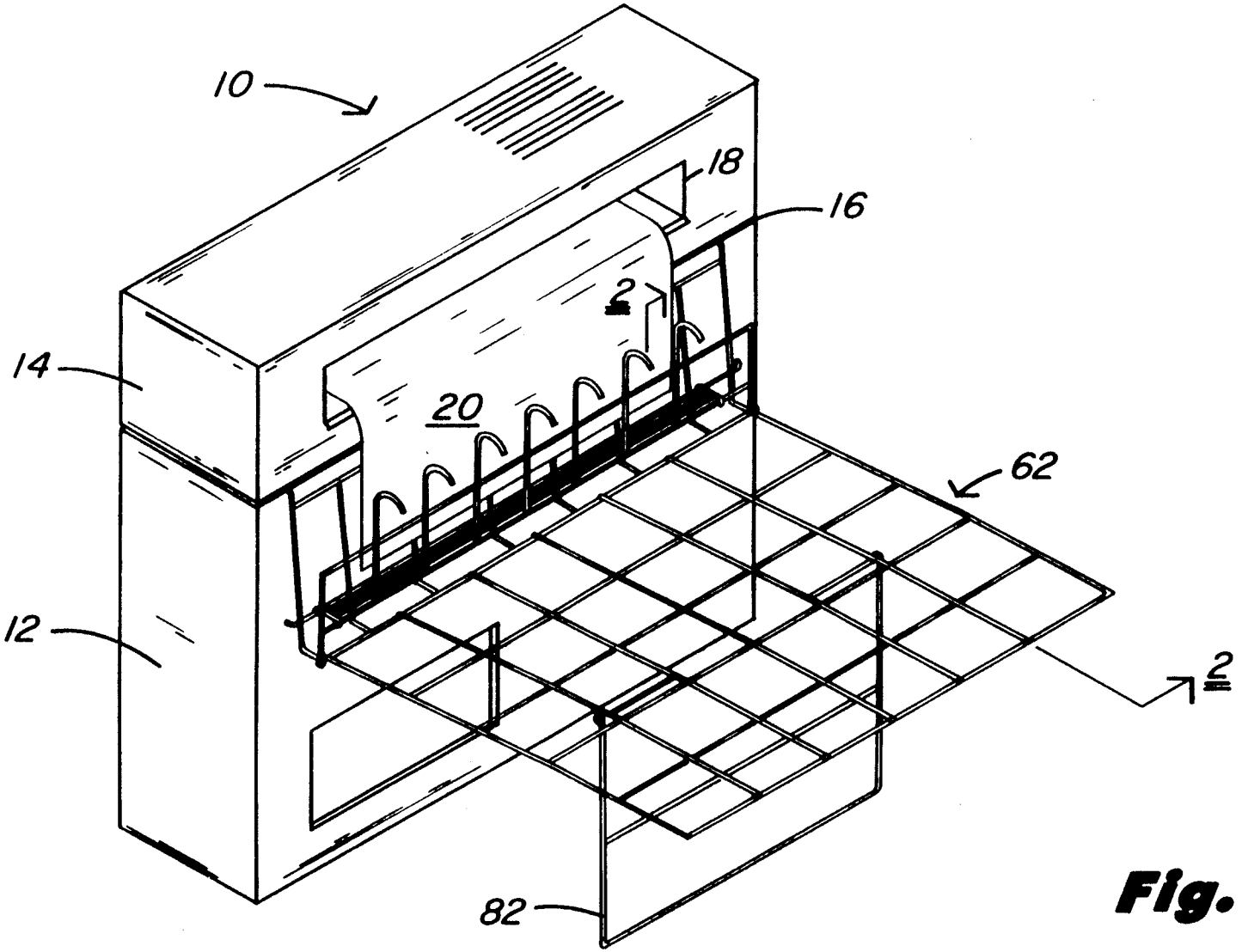
FIG. 1A and is an isometric view of cut sheets being fed from a large format or E-size plotter into the novel sheet receiving and stacking apparatus according to this invention.
Figure 1B:
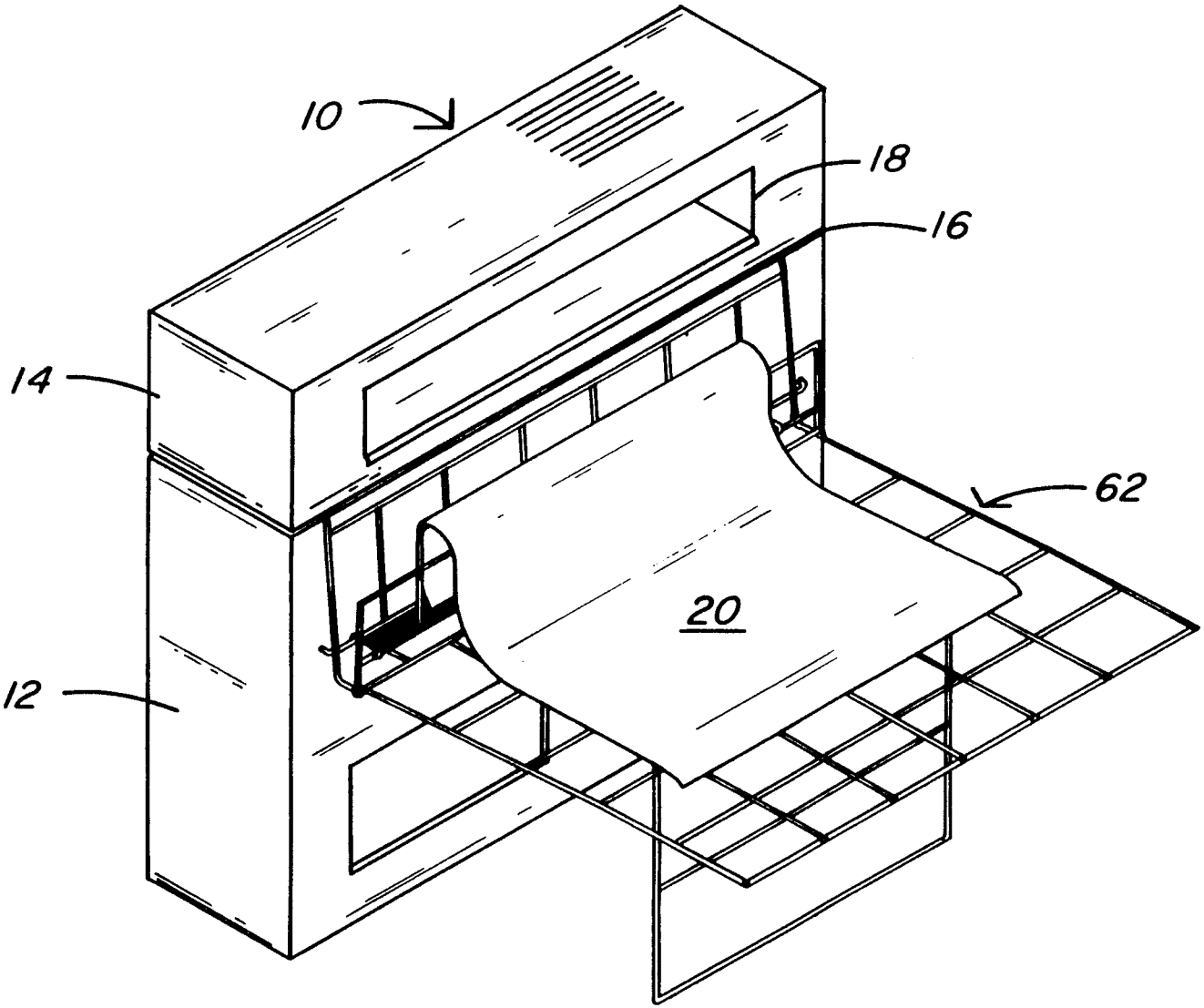
FIG. 1B is an isometric view of the cut sheets after they have moved into the generally U-shaped input bin of the sheet receiving apparatus where they are rotated away from the sheet feeding mechanism of the plotter.

Referring now to FIGS. 1A and 1B, there is shown a large scale plotter which is designated generally as 10 and includes a lower housing 12 and a removable upper housing 14 which is separated from the lower housing by a space 16. The space 16 is used to receive the sheet receiving and stacking apparatus according to the present invention. This sheet stacking apparatus is constructed as shown using a wire or bar grid configuration with wires and grids arranged in the planes shown and running generally perpendicular to one another to define the various members of the paper stacking apparatus described and claimed herein. The lower housing 12 is designed to support and shield a large size plotter (not shown) mounted therein. The upper housing 14 is designed to support and shield a sheet feeding mechanism, also not shown. The upper housing 14 includes a sheet feed window of port 18 from which cut sheets 20 are fed into the wire grid sheet stacking apparatus described further below. Typically, this wire grid will be constructed of 3/16 inch steel wire which has been plated with nickel-chrome.

The sheet stacking apparatus includes a back member consisting of a plurality of upstanding bars or wires 22 which are integrally joined at the top ends thereof with a continuous horizontal bar 24 and are further integrally joined at their lower ends with a floor or bottom member. This bottom member also consists of a plurality of horizontal floor bars or wires 26. The floor or bottom bars or wires 26 are integrally joined to a continuous horizontal front floor bar 28 whose ends extends slightly past the edges of the end floor bars. These ends of the front floor bar 28 receives upstanding end bars 30 and 32 of a front support member of the apparatus.

The front support member of the apparatus further comprises a horizontal bar 34 which is integrally joined with the upstanding end bars 30 and 32, and the frame consisting of the bar members 30, 32, and 34 is also referred to herein and claimed as a first section of the front support member of the sheet receiving bin. A plurality of vertical hook-shaped ribs 36 abut the inside surface of the horizontal bar 34, and these ribs 36 form a second section of the front support member. The lower ends of the hook-shaped ribs 36 are integrally joined to a horizontal front bar 38 of an intermediate sheet receiving tray 40. The sheet receiving tray 40 is positioned as shown between the front and back members of the U-shaped sheet receiving bin and is spaced vertically above the floor or bottom member 26 of the sheet receiving apparatus.

Figure 2:
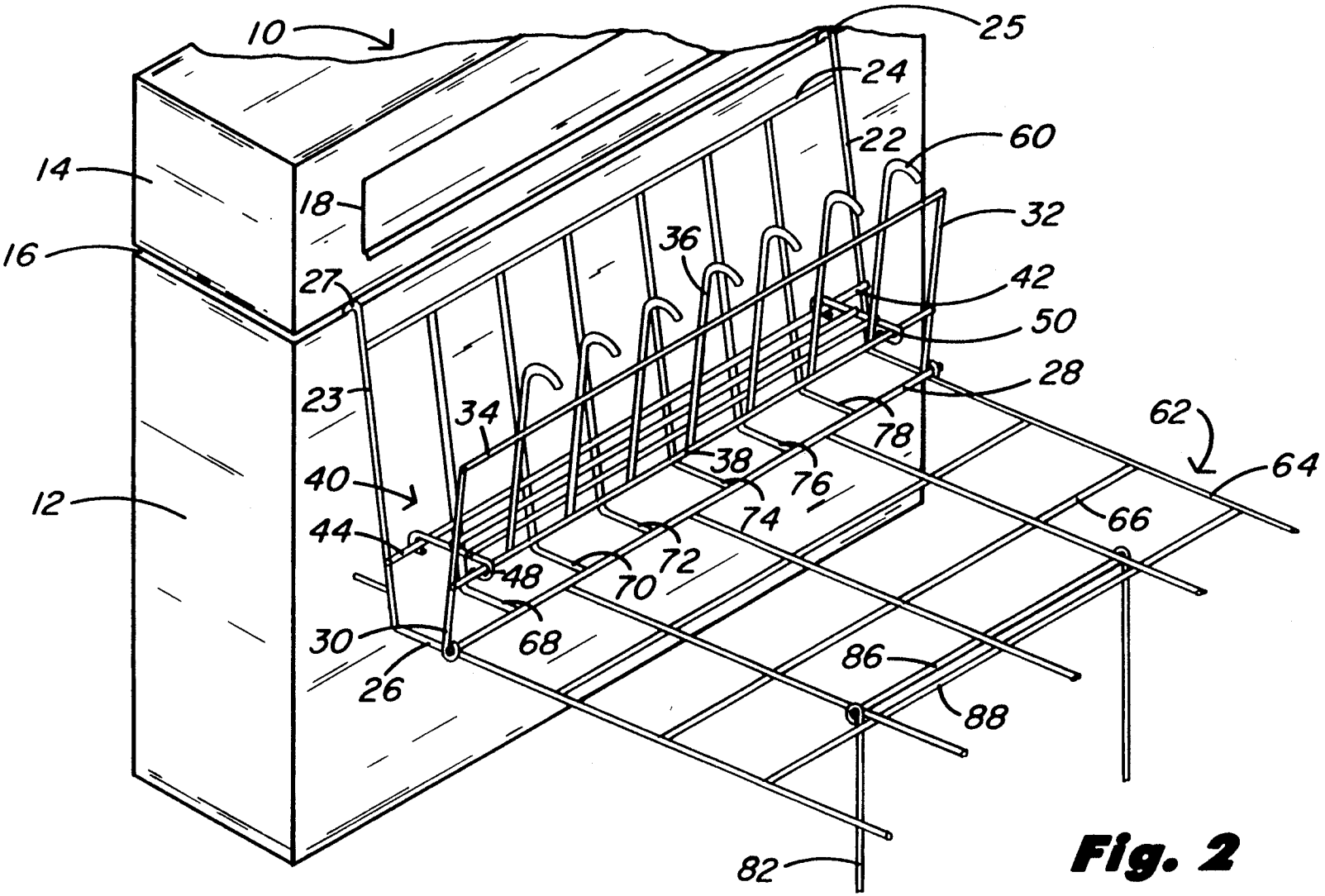
FIG. 2 is an enlarged isometric view of U-shaped sheet receiving area of the sheet stacking apparatus of a preferred embodiment of the invention.

The back support member further comprises a rear horizontal bar 42 whose curved ends 44 and 46 extend as shown into openings of a front wall of the lower housing member 12. A pair of end fasteners 48 and 50 having hook-shaped downwardly facing ends support the tray member 40 on the horizontal bars 38 and 42. In addition, the tray member 40 further includes a pair of spaced centrally located horizontal bars 52 and 54 which extend as shown from one end of the tray member 40 to the other as seen in more detail in the enlarged isometric view in FIG. 2. As further described below, the cut sheets 20 are fed into a downward direction as shown and into the sheet receiving tray 40 in the direction of the two horizontal bars 52 and 54. From this location each cut sheet will rotate in a direction of the arrow 56 to first form a loop 57 before coming to rest in the position shown on the tops 60 of the upstanding vertical rib members 36. From this position, the sheets extend onto the upper surface of the output tray 62 described below, and there is no sliding friction contact between adjacent sheets as is the case with the use of prior art paper trays.

Figure 3:
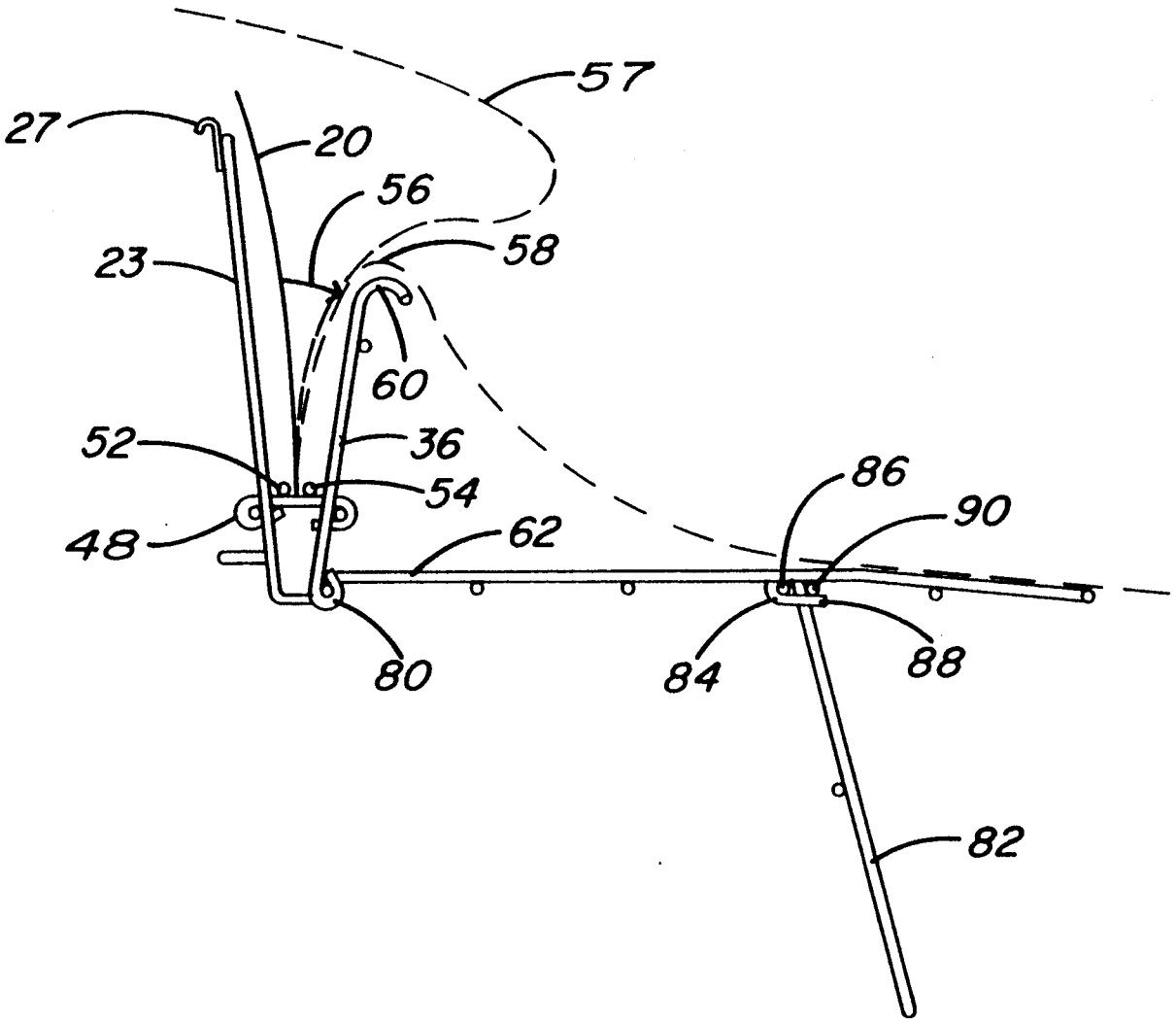
FIG. 3 is a cross-sectional view taken along lines 2—2 of FIG. 1A.

A sufficient loop 57 is required to assure that the media falls in the direction of the arrow and onto the output tray 62 as indicated in FIG. 3. The size of the loop 57 may be controlled by varying the distance between the plotter exit window 18 and the sheet receiving tray 40. This distance in turn determines the force/weight balance on the sheets being stacked and should be large enough to provide a loop 57 which is sufficiently large to produce enough downward momentum of the sheets to assure good "loop/flip" stacking action on the output tray 62 as indicated above.

As shown in FIG. 1A, the cut sheets 20 proceed further over the tops 60 of the rib members 36 and onto the top surface of an output tray which is designated generally as 62. This rotational movement of the cut sheets 20 in the direction of the arrow 56 and over the vertical upstanding rib members 36 of the front support and then down into the output tray 62 provides an overall stacking weight distribution within the stacked sheets 20 which tends to prevent paper curling and crumpling. This desirable stacking weight distribution is in significant contrast to typical prior art paper bin stacking approaches where all of the cut sheets are stacked one on top of another in a relatively small rectangular area where the sheets may sometime be difficult to retrieve.

The range of sheet sizes that can be stacked using the above described method and apparatus is facilitated by the weight distribution between the convex ribs 60 of the front section of the bin and the output sheet receiving tray 62. Smaller sheets will hang freely over the tops of the convex upstanding ribs and there be held in static equilibrium. Larger sheets will be draped over both the rib members 60 and the adjacent output tray 62 to reach a static equilibrium. Thus, there are two force/weight equilibrium conditions that may be present in the above operation. But it is important to note that in either case, there is no condition where sheets are fed into direct sliding contact with each other and with a significant dynamic friction therebetween. In addition, there is no impacting of the adjacent surfaces and edges of previously deposited sheets in the manner indicated above when prior art trays are used to accumulate sheets received one on top of another.

The output tray 62 consists of a plurality of integrally joined and perpendicularly arranged horizontal bars 64 and 66. These parallel horizontal bars 66 are connected to the lower bar member 28 of the sheet receiving apparatus at the points 68, 70, 72, 74, 76, and 78. The horizontal bar member 28 is free to rotate as indicated in FIG. 3 within the lower hook sections 80 of the vertical end bars 30 of the front support member. A leg support member 82 has a hook section 84 on its upper end which loops around one of the horizontal bars 86 of the output paper collection tray 62. The tail 88 of the hook 84 comes to rest against an adjacent bar 88 of the output tray 62. The rotatable output tray 62 and its stand support member 82 thus render the entire apparatus collapsible when not in use.

EXAMPLE

The following parameters are given by way of example only and are in no way limiting on the scope of the appended claims. These parameters are merely intended to describe a typical handling and stacking operation and illustration of how the novel sheet stacking apparatus according to the present invention is uniquely adapted and operable to rapidly and efficiently stack the continuously moving cut sheets out of the way of interference with the upstream motion of paper flow. In addition, this operation provides for the simultaneous and uniform stacking of cut sheets with a minimum of crumpling, curling, and paper slippage. Furthermore, the present apparatus is totally passive in operation and requires no motors or other moving parts.

Using the above apparatus, fifty (50) to one hundred (100) cut sheets of a standard size "C", "D", or "E" (Standard American and European paper size) are fed into the sheet receiving bin at a typical rate of one inch per second. Size "C" is 17×22 inches; Size "D" is 22×34 inches, and Size "E" is 34×44 inches according to this standard. However, Vellum and translucent medias may also be stacked. These sheets will have a momentum so that when the leading edge of the cut sheets reach the sheet receiving tray 40, the individual sheets will rotate in the direction of the arrows 56 shown in FIG. 3 and will traverse the dotted line path 58. These sheets will then come to rest in the position shown in FIG. 1B.

The paper stacker described above was developed primarily for use with an electrostatic plotter designed for handling paper, Vellum, and translucent media. However, other types of plotters and other types of media are contemplated within the scope of the appended claims.

Figure 4:
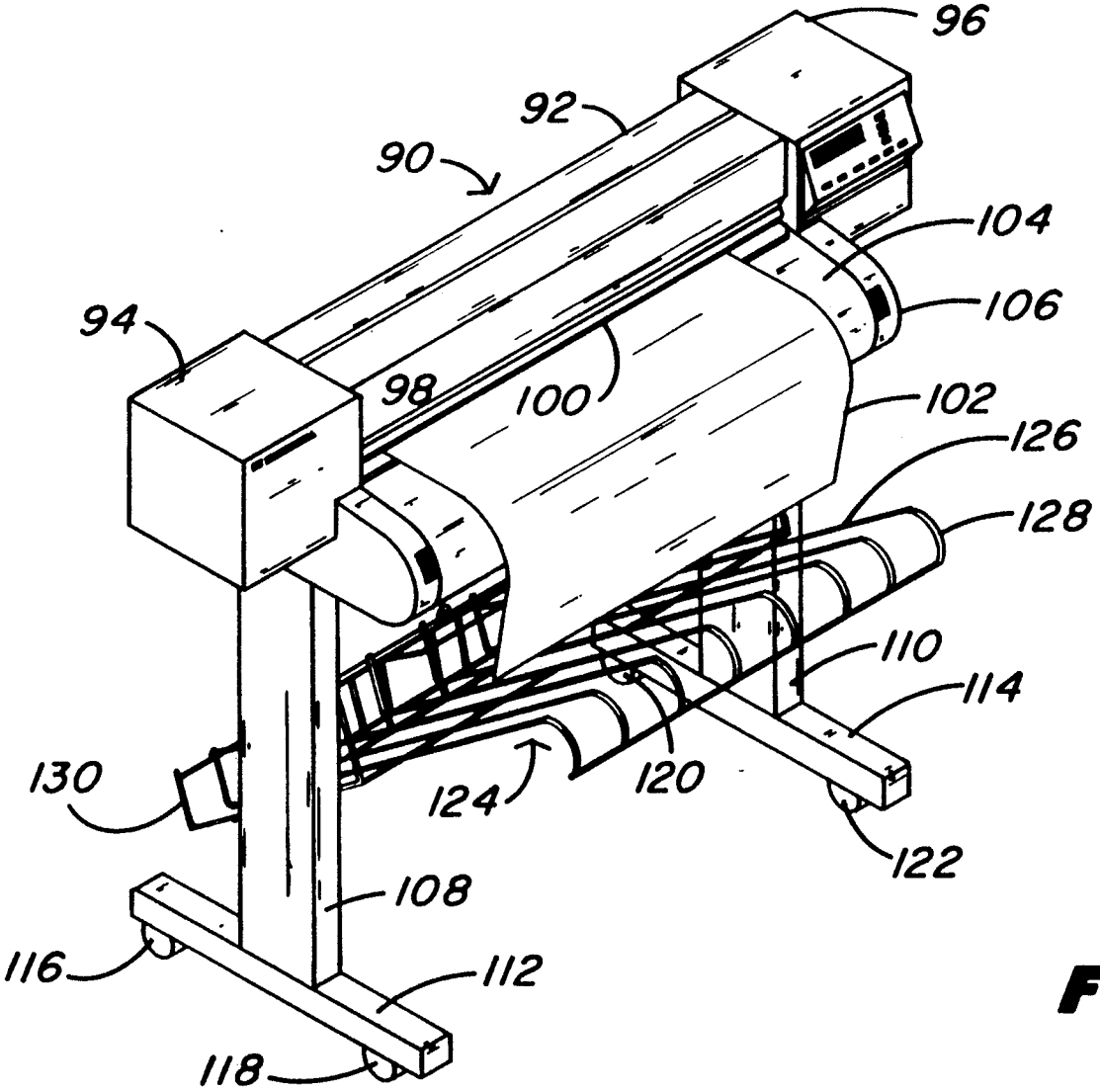
FIG. 4 is a perspective view of a plotter resting on a stand from which the hanging or suspension bin is located to receive a cut sheet of paper being ejected from the output of the plotter.

Referring now to FIG. 4, there is shown in perspective view the Hewlett Packard E-size DesignJet TM monochrome inkjet plotter designated generally as 90 and includes a main plotter housing 92 which extends between a drive mechanism housing 94 located on the left hand end of the plotter and a control panel housing 96 positioned on the right hand end of the plotter 90. The front facing side 98 of the plotter housing 92 has an output port or opening 100 therein from which the printed media will be fed to the media stacker as indicated over the contoured surface of an exit platen 104 which also functions as a cover for the roll feed mechanism.

The plotter 90 is configured to rest on a portable stand which includes upstanding leg members 108 and 110 shown in more detail below in FIG. 5A. This stand further includes horizontal stand support members 112 and 114 having, respectively, pairs of rollers 116, 118, and 120, 122.

The hanging or suspension paper receiving bin is designated generally as 124 in FIG. 4 and includes a front wall comprising a bar or wire grid network indicated by a plurality of front wall bar or wire grid members 126. These front wall members 126 are all integrally joined to a corresponding plurality of U-shaped or hook-shaped members 128 defining concave upper surfaces over which the cut sheets of paper 102 uniformly come to rest after leaving the plotter 90. As will be described in more detail below, the front wall bar grid network members 126 are integrally joined to a corresponding plurality of bottom wall wire grid members 130 as shown in detail and described below with reference to FIG. 7A.

Figure 5A:
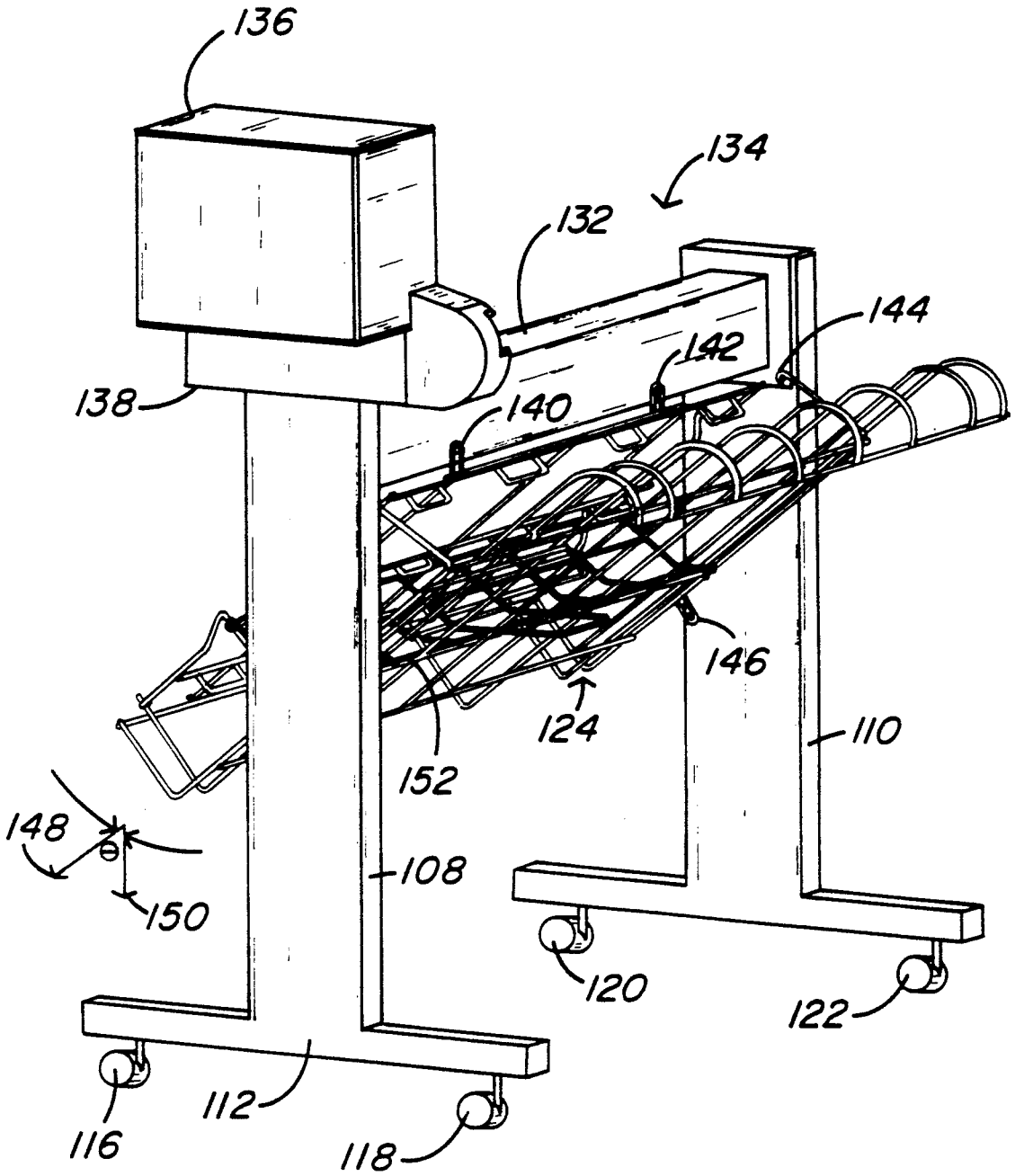
FIG. 5A is a perspective view of the stand and hanging bin suspended therefrom, with the plotter of FIG. 4 being removed in order to show more detail of the bar or wire grid network defining the length, width, and depth dimensions of the hanging bin.

Referring now to FIG. 5A, the Hewlett Packard DesignJet TM monochrome inkjet plotter 90 has been removed from the major cross support member 132 of the portable stand designated generally as 134. The stand 134 includes housing members 136 and 138 configured as shown on the near end of the portable stand 134 for receiving matching housing plotter drive mechanisms which are well known components of the E-size plotters and are not described in detail herein.

The hanging or suspension bin 124 is secured to the cross support member 132 of the plotter stand by a pair or U-shaped hooks 140 and 142 and is further secured to the upstanding leg members 108 and 110 by an upper U-shaped hook member 144 and a lower U-shaped hook member 146. Only the hooks 144 and 146 are shown because of the perspective angle of FIG. 5A. However, similar hook members are found on the inner facing surface of the upstanding leg member 108. The hanging bin 124 has a depth dimension which extends in the direction of the arrow 148 at a predetermined angle of approximately fifty (50) degrees with respect to vertical and indicated at angle $\theta$ in FIG. 5A. As described in more detail below with reference to FIGS. 5B and 7C, the hanging bin 124 includes an adjustable tray as indicated by the darkened gridwork 152 in FIGS. 5A, 5B, and 6 are adjustably mounted along the depth dimension in the direction of arrow 148 between the front and back walls of the sheet receiving bin 124.

Figure 5B:
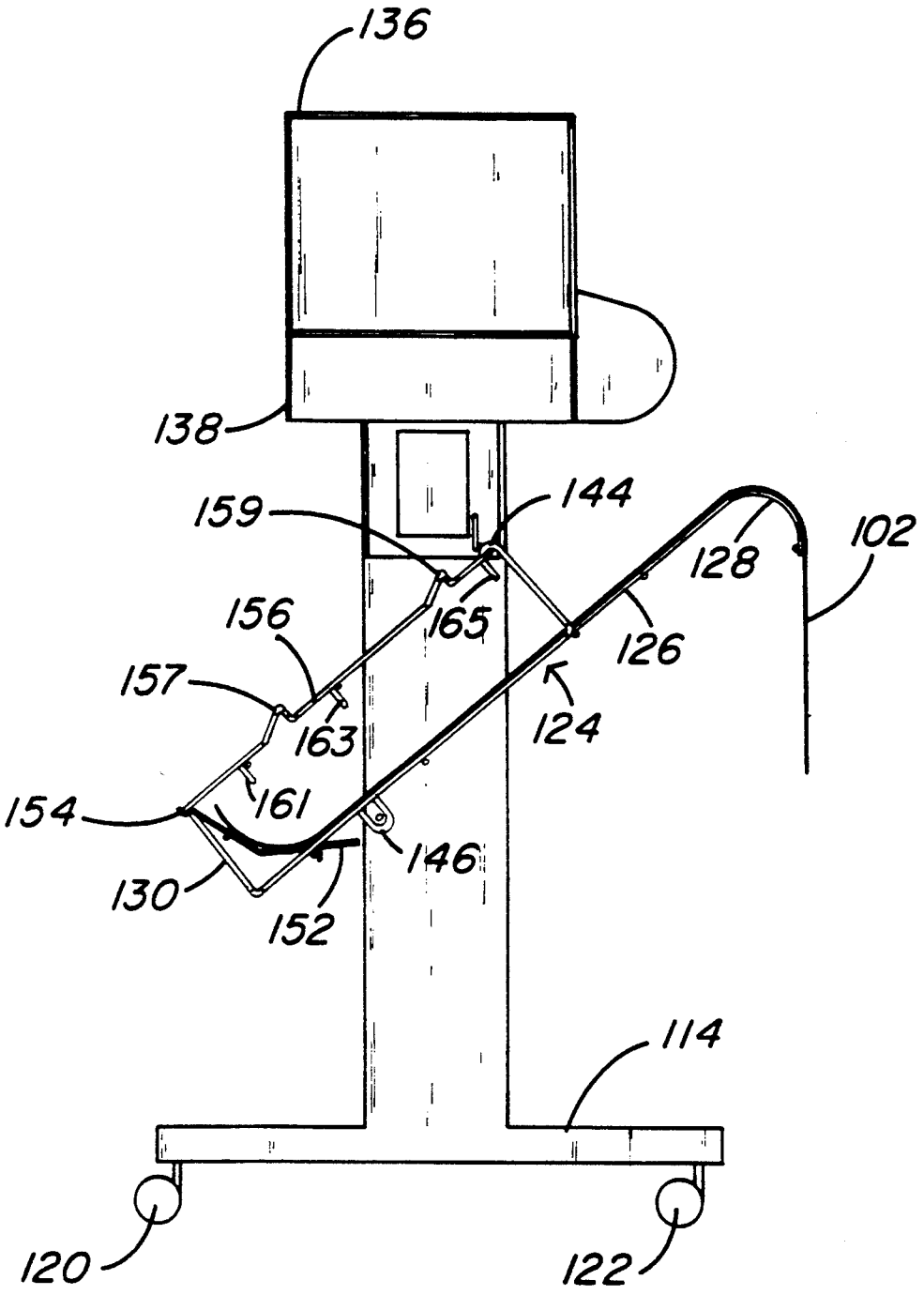
FIG. 5B is an elevation view taken along lines B—B of FIG. 5A.

Referring now to the elevation view of the hanging bin 24 as shown in FIG. 5B, the adjustable sheet receiving tray or lever 152 is shown positioned at its lowermost location adjacent the bottom wall 130 of the hanging bin 124, coming to rest at the vertex 154 of the bottom wall 130 and the back wall 156 of the bin 124. The back wall 156 of the bin 124 provides for a second and third levels of vertical adjustment for the tray or lever 152, and this is accomplished by means of the supporting generally V-shaped receptacles 157 and 159. The specific horizontal spacing of these two aligned V-shaped receptacles 157 and 159 is shown in more detail below with reference to FIG. 7B, and the back horizontal rib member of the sheet receiving tray 152 may be positioned either on the floor of the bin at the vertex 154 or in one of the two receptacles 157 and 159 to adjust the tray 152 to one of three vertical locations within the bin 124. In addition, each vertical location 154, 157, and 159 in the back wall 156 is positioned adjacent to a hook-shaped extension 161, 163, and 165, respectively, which operates to prevent the sheets being stacked from curling up on the back wall of the bin 124. Further with regard to FIG. 5B, it will be understood that the exact position of the hook members 144 and 146 may be changed and mounted on pens different from those shown in FIG. 5B in order to adjust the angle of suspension $\theta$ as described above with reference to FIG. 5A.

Figure 6:
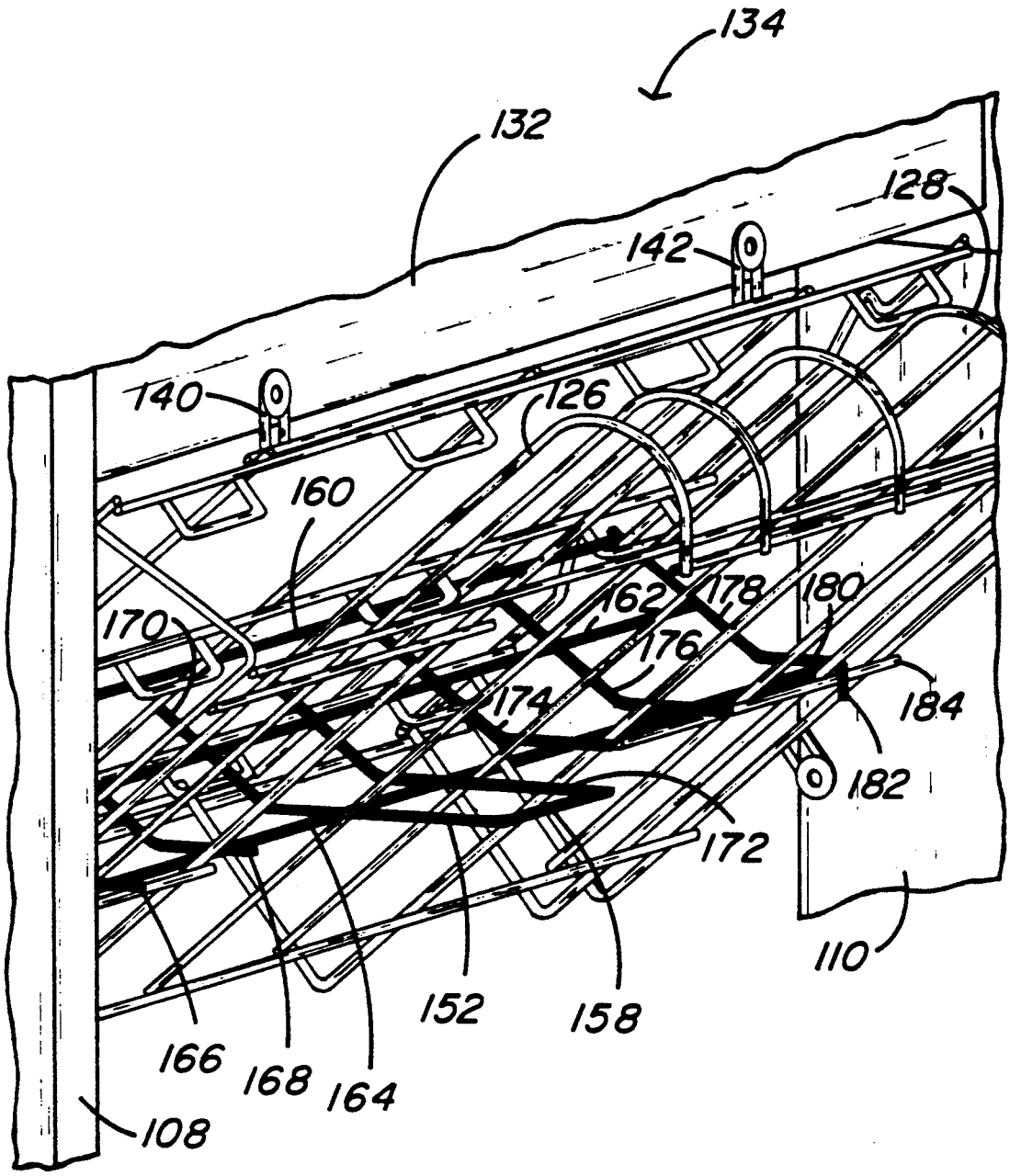
FIG. 6 is an enlarged fragmented isometric view of a portion of the bar or wire grid network in which the adjustable tray or lever in FIGS. 5A and 5B is positioned.

Referring now to FIG. 6, this enlarged fragmented view is presented herein in order to precisely show how the adjustable tray or lever 152 is positioned in and comes to rest on the front and back wall members of the U-shaped wire grid suspension bin 124. The adjustable sheet receiving tray 152 includes a central handle member 158 which is easily accessible to an operator from the front wall of the bin 124. This operator may manually and easily lower and raise the position of the tray 152 by accessing the outwardly projecting central handle member 158 which extends between the wire grid network defining the front wall member of the U-shaped bin 124.

The adjustable tray or lever 152 is constructed of a plurality of horizontal rib shaped members 160, 162, and 164 and a plurality of perpendicularly spaced bar or grid members 166, 168, 170, 172, 174, and 176. The rear horizontal rib member 160 is designed to rest on the previously described support sections 157 and 159 in the back wall 156 of the bin, and the outside rib-like members 178 have angled outer end portions 180 with hook-shaped ends 182 thereon configured to come to rest on one of the horizontal rib members 184 forming part of the front wall of the U-shaped suspended bin 124. Thus, the adjustable tray 152 may be positioned at one of three different locations along the depth dimension of the U-shaped bin 124 to thereby accommodate three different lengths of cut sheets being processed through the E-size plotter 90.

Figure 7A:
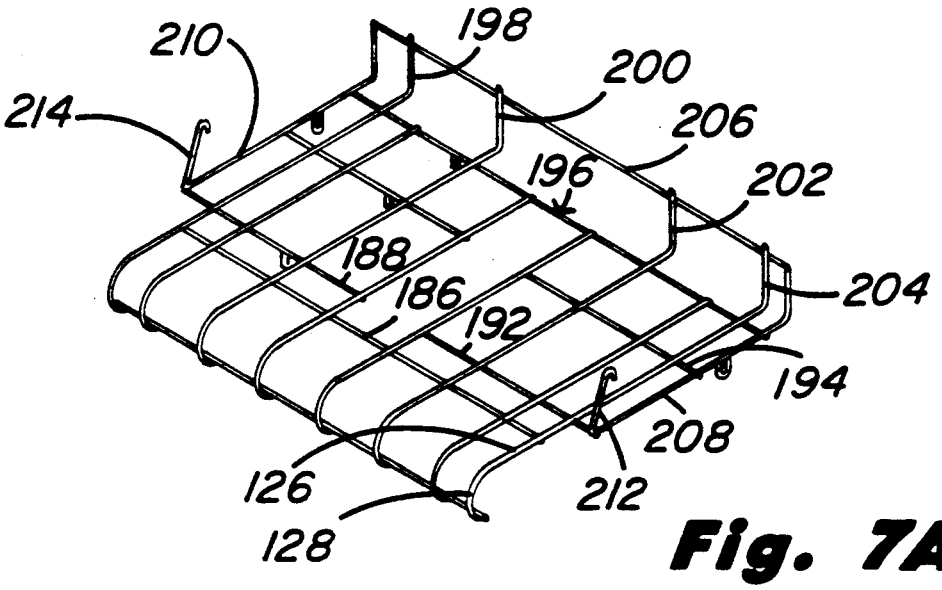
FIG. 7A is a perspective view showing only the front wall of the hanging bin bar grid network.
Figure 7B:
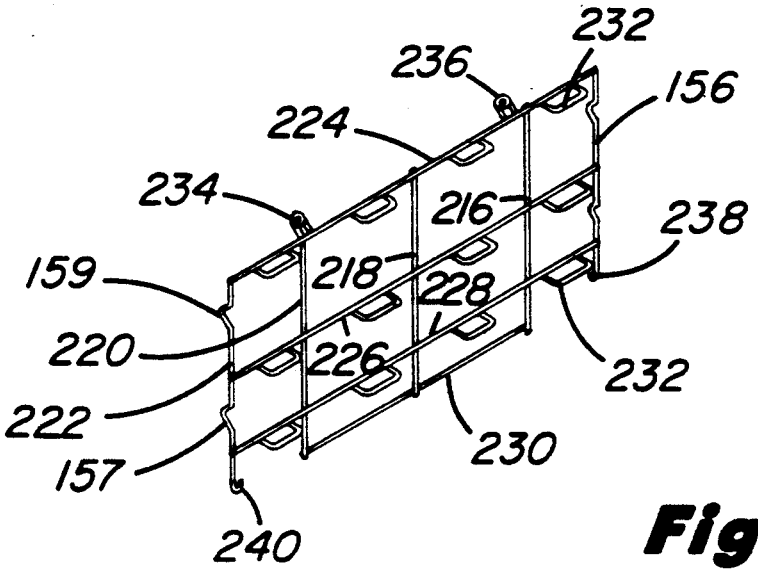
FIG. 7B is a perspective view showing only the back wall of the hanging bin bar grid network.
Figure 7C:
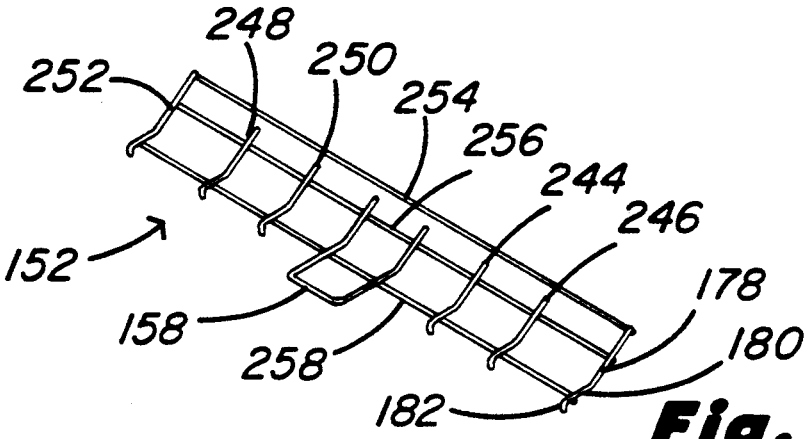
FIGS. 7C is a perspective view showing only the adjustable tray or lever which fits between the front and back walls of the bar grid hanging bin network.

Referring now in sequence to FIGS. 7A through 7C, the front wall section of the U-shaped bin shown in FIG. 7A includes eight (8) vertical rib and hook members; e.g. 126 and 128, configured in the geometry shown and being integrally joined in a gridwork by an upper long horizontal rib member 186 and shorter intermediate rib members 188, 190, and 192, 194. The lower ends of the vertical ribs 126 are also joined by a lower long horizontal rib member 196, and every other one of the vertical rib members 126 is bent in an L-shaped configuration at the ends 198, 200, 202, and 204 to form part of the bottom wall of the U-shaped bin 124. Here they are integrally joined to a lower outer horizontal rib member 206 in the geometry shown. A pair of shorter outer vertical rib members 208 and 210 are joined to the upper outwardly extending hook-shaped members 212 and 214 which function to connect to pens on the housing of the plotter stand as previously described to thereby set the angle of slant for the U-shaped bin 124.

Referring now to FIG. 7B, this figure depicts the bar grid structure for the back wall of the U-shaped hanging bin 124, and includes a plurality of vertical wire bars or grids 156, 216, 218, 220, and 222 which are interconnected by a plurality of horizontal grid members 224, 226, 228, and 230 in the particular geometry shown. Each of the longer horizontal cross grid members 224, 226, and 228 includes four symmetrically spaced U or hook-shaped members 232 which are all disposed above the floor of the adjustable tray 152 and operate to prevent the ends of the sheets entering the tray from curling up on the back wall of the U-shaped bin 124. These anti-curl members are identical in geometry and function to that of the earlier described members 161, 163, and 165 in FIG. 5B above. The back wall of the U-shaped bin 124 is secured by means of a pair of hooks 234 and 236 to pen members on the portable stand for the plotter, and the outer rib members 156 and 222 of the back wall have their ends configured with hooks 238 and 240 for attachment to mating pens (not shown) on the legs of the portable stand for the plotter for securing the U-shaped bin 124 at the desired angle $\theta$ as previously described with reference to FIG. 5A.

Referring now to FIG. 7C, the adjustable tray 152 has been partially described above with reference to FIG. 6, and reference numeral 158 designates the handle portion of the tray adapted for manual adjustment by an operator. This adjustable tray 152 has also been described as having a plurality of angled rib-shaped members 178 and 180 defining the width dimension of the tray 152 and having 90° angled ends 182 which are adapted to come to rest on a mating rib member 184 of the front wall of the U-shaped bin. The adjustable tray 152 shown in FIG. 7C further includes pairs of intermediate cross ribs 244, 246, and 248, 250 and an opposing end rib member 252 configured in like manner to the right hand cross rib defined by section 178, 180, and 182, previously described. These cross rib members are all integrally joined in the geometry shown by three horizontal rib members 254, 256, and 258. As previously indicated the rear horizontal rib member 254 is the pivotal rib member which fits into one of the two receptacles 157 and 159 in the back wall of the U-shaped bin 124 or comes to rest in the vertex 154 at the floor 130 of the wall. This configuration provides the adjustable tray with one of three different available locations along the depth dimension within the U-shaped bin 124.

Various modifications may be made in and to the above described embodiment without departing from the scope of this invention. For example, the size, shape, and geometrical configuration of the U-shaped sheet receiving input bin and its associated flat output tray extending therefrom may be modified in accordance with paper size, weight, and transport speed requirements. In addition, the present invention is not limited to the use of a bar or wire grid network, and such network may, if desired, be replaced with a bin made of plastic or sheet metal as long as the shape and friction of the surface areas of the bin are functionally equivalent to those of the bar grid network described herein. Accordingly, these and other design variations of the above described preferred embodiment are clearly within the scope of our appended claims.

We claim:

1. A paper receiving bin for a printer or plotter including a front wall, a back wall, and a bottom wall all joined together in a bar or wire grid network to define a sheet receiving region with a length dimension, width dimension, and depth dimension defining at one end of said bin an opening for receiving paper fed from an output of said printer or plotter, said front wall further including a plurality of generally U-shaped members having upwardly facing convex surfaces for receiving stacked sheets of paper falling into said opening of said bin; and attachment means on said wire or bar grid network for hanging said bin from one or more upstanding leg members of a support stand for said printer or plotter and for positioning said depth dimension of said bin at a predetermined angle greater than zero degrees with respect to the free fall vertical direction of paper ejected from said printer or plotter.

2. The bin defined in claim 1 wherein said attachment means includes attachment devices secured to said front and back walls of said bin for receiving pens on a support stand for said printer or plotter.

3. The bin defined in claim 2 wherein said attachment devices are contoured bar or wire members spaced at different locations along said front and back walls of said bin for receiving said pens so as to orient said front wall at said predetermined angle with respect to vertical.

4. The bin defined in claim 1 which further includes an adjustable tray disposed in said bin between said front and back walls thereof.

5. The bin defined in claim 2 which further includes an adjustable tray disposed in said bin between said front and back walls thereof.

6. The bin defined in claim 3 which further includes an adjustable tray disposed in said bin between said front and back walls thereof.

7. The bin defined in claim 6 wherein said back wall has protruding elements thereon for terminating media curl adjacent to the bottom of said adjustable tray.

* * * * *